United States Patent [19]

MacDougall

[11] 3,983,560

[45] Sept. 28, 1976

[54] CASSEGRAIN ANTENNA WITH IMPROVED SUBREFLECTOR FOR TERRESTRIAL COMMUNICATION SYSTEMS

[75] Inventor: James Bruce MacDougall, New Lenox, Ill.

[73] Assignee: Andrew Corporation, Orland Park, Ill.

[22] Filed: June 6, 1974

[21] Appl. No.: 476,775

[52] U.S. Cl. ..... 343/781 CA; 343/840

[51] Int. Cl.[2] ..... H01Q 19/18

[58] Field of Search..... 343/781, 837, 840

[56] References Cited

UNITED STATES PATENTS

| | | | |
|---|---|---|---|
| 3,209,361 | 9/1965 | Potter | 343/781 |
| 3,241,147 | 3/1966 | Morgan | 343/781 |
| 3,254,342 | 5/1966 | Miller | 343/837 |
| 3,706,999 | 12/1972 | Tocquec et al. | 343/837 |

*Primary Examiner*—Eli Lieberman

*Attorney, Agent, or Firm*—Leydig, Voit, Osann, Mayer & Holt, Ltd.

[57] ABSTRACT

A Cassegrain antenna for use in terrestrial communication systems. The antenna has the conventional subreflector including a central area which provides tapered illumination of the entire main reflector, and a peripheral area which directs spillover from the central area onto the peripheral portion of the main reflector to improve the uniformity of illumination of the main reflector, thereby improving illumination efficiency and reducing gain loss due to spillover. The central and peripheral areas of the subreflector are preferably both surfaces of revolution of conic sections of the same kind, such as hyperboloids, ellipsoids or paraboloids, although the peripheral area may be a frustoconical surface if desired. The virtual focal points of the two conic sections of the subreflector are both coincident with the phase center of the feed horn.

6 Claims, 5 Drawing Figures

CASSEGRAIN ANTENNA WITH IMPROVED SUBREFLECTOR FOR TERRESTRIAL COMMUNICATION SYSTEMS

DESCRIPTION OF THE INVENTION

The present invention relates generally to antennas for use in terrestrial communication systems and, more particularly, to a Cassegrain antenna having an improved subreflector.

It is a primary object of this invention to provide a Cassegrain antenna with an improved subreflector that provides increased total antenna efficiency and, therefore, increased gain.

A more specific object of the invention is to provide an improved Cassegrain antenna of the foregoing type that achieves more uniform illumination of the main reflector dish without any increase in spillover.

It is another object of the invention to provide such a Cassegrain antenna that requires no modification to the standard reflector dish, shroud, or radome. In this connection, a related object of the invention is to provide such an antenna that can be produced by relatively inexpensive field modifications of only the feed assembly and subreflector portions of existing prime focus feed antennas.

Other objects and advantages of the invention will be apparent from the following detailed description and the accompanying drawings, in which.

Figure 1:
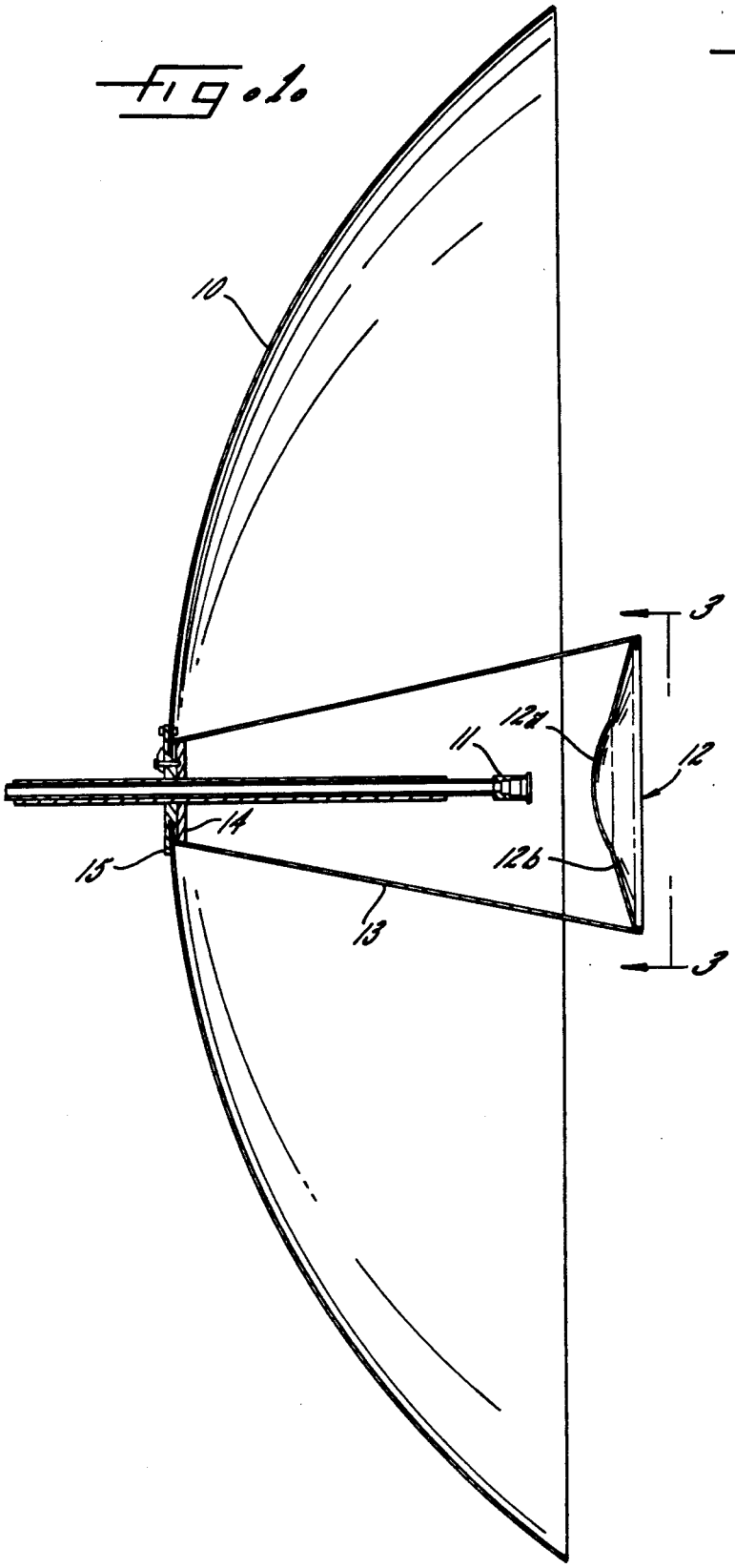
FIG. 1 is a vertical section taken through the middle of a Cassegrain antenna embodying the invention.
Figure 2:
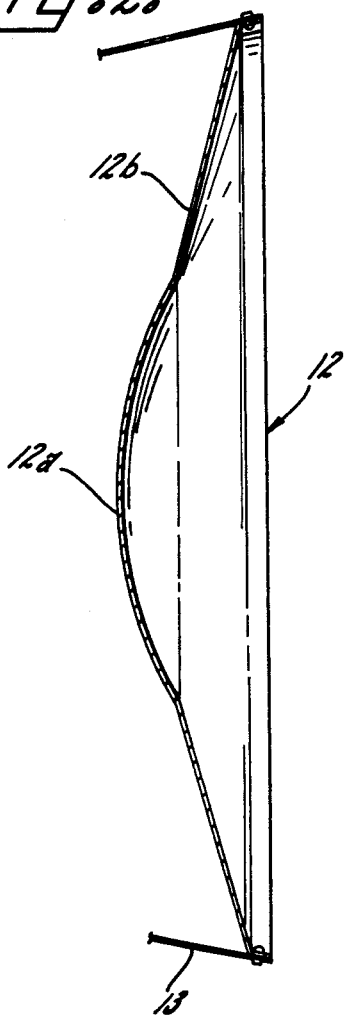
FIG. 2 is an enlarged section of the subreflector portion of the antenna of FIG. 1.
Figure 3:
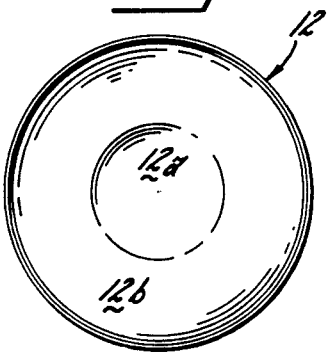
FIG. 3 is a full end elevation of the subreflector portion of the antenna of FIG. 1.

While the invention will be described in connection with certain preferred embodiments, it will be understood that it is not intended to limit the invention to those embodiments. On the contrary, it is intended to cover all alternatives, modifications and equivalents as may be included within the spirit and scope of the invention as defined by the appended claims.

Turning now to the drawings and referring first to FIGS. 1–3 and 5, there is illustrated a Cassegrain antenna comprising a parabolic main reflector dish 10, a primary feed horn 11, and a hyperbolic subreflector 12. The central portion of the hyperbolic subreflector 12 is shaped and positioned so that its virtual focal point $F_0$ (FIG. 5) is coincident with the phase center of the feed horn 11 and its real focal point $F_1$ (FIG. 5) is coincident with the virtual focal point of the parabolic main reflector dish 10. In the transmitting mode, the feed horn 11 illuminates the subreflector 12, the subreflector reflects this energy in a spherical wave about its real focal point $F_1$ to illuminate the main reflector dish 10, and the main reflector dish converts the spherical wave to a planar wave across the face of the paraboloid. In the receiving mode, the parabolic dish 10 is illuminated by an incoming planar wave and reflects this energy in a spherical wave to illuminate the subreflector 12, and the subreflector reflects the incoming energy into the feed horn 11.

In order to support the subreflector 12 in the desired position, the subreflector is mounted on the large end of a fiberglass cone 13 fastened at its smaller end to a hub 14 fitted within a standard mounting ring 15 for the main reflector dish 10. As will be understood by those familiar with this art, the fiberglass cone 13 is very thin and introduces only a small amount of VSWR in the antenna system.

Microwave antenna gain is generally stated in dBi, indicating decibles relative to the gain of an isotropic antenna, which is a hypothetical "ideal antenna" or "point source" which radiates equally in all directions. The gain of a parabolic antenna depends upon its size, frequency and illumination. Maximum gain would occur if the illumination were uniform in phase and amplitude across the aperture of the parabola. In this ideal case, the gain G would merely be the ratio of the aperture A of the parabola to the area of the hypothetical isotropic antenna, i.e.:

$$G = \frac{A}{\lambda^2/4\pi} = \frac{4\pi A}{\lambda^2}$$

Where $A$ = area of parabolic aperture $\lambda^2/4\pi$ = area of isotropic antenna $\lambda$ = wavelength of operating frequency This upper gain limit is often referred to as 100 percent antenna efficiency. In the practical case, the amplitude and phase illumination errors, spillover loss, reflector surface tolerance error and other losses typically reduce the gain to slightly over one half of this value. These gain degradations are noted by the efficiency factor $\eta$, so that $$G = \eta\, 4\, \pi\, A / \lambda^2$$

Since a bel is the logarithm to the base 10 of a ratio of two amounts of power, and a decibel is 0.1 of a bel, the gain G is converted to power gain in decibels as follows:

$$G \text{ (in dBi)} = 10 \log_{10} \eta\, 4\, \pi\, A / \lambda^2$$

Conventional antenna feeds provide an illumination taper of approximately 10 dB at the edge of the parabola from that at the center, which results in an antenna efficiency of 58 to 63 percent. Taking other factors into account, most manufacturers guarantee antenna efficiencies of 55 percent.

Figure 4:
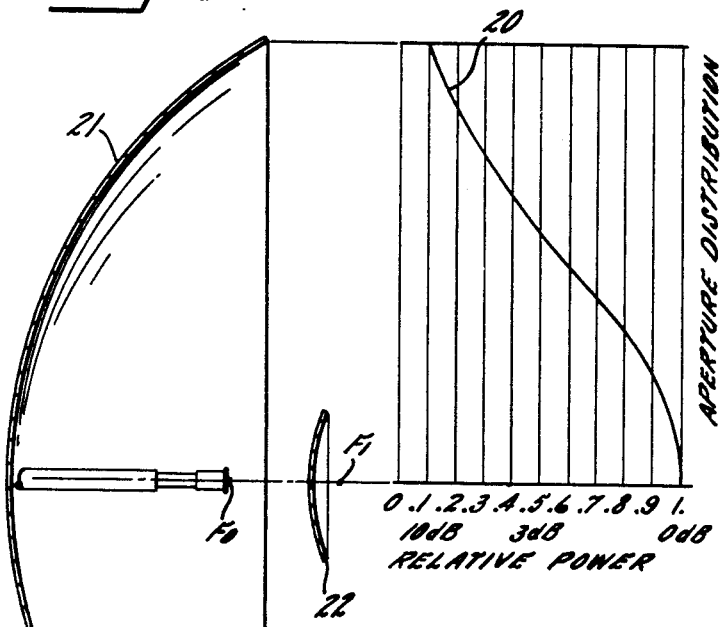
FIG. 4 is a schematic vertical section of a conventional Cassegrain antenna and a power intensity profile therefor.

Antenna efficiency is principally a tradeoff between losses due to a nonuniform power intensity profile and spillover losses. In order to minimize spillover losses, the main reflector and subreflector of a Cassegrain antenna are generally designed to provide a predetermined "taper" in the power intensity profile across the aperture of the main dish 10. That is, the power intensity of the antenna is a maximum in the central area of the main dish and tapers off to a minimum at the periphery of the main dish, so that any spillover at the periphery of the dish 10 does not significantly reduce the total antenna gain. For example in FIG. 4 there is illustrated a typical power intensity profile 20 for a Cassegrain antenna having a parabolic main reflector dish 21 and a hyperbolic subreflector 22. This profile 20 represents the typical 10 dB taper. In this conventional Cassegrain antenna, reducing the taper to provide more uniform illumination for improved efficiency is counteracted by increased spillover losses.

In accordance with one important aspect of the present invention, the uniformity of illumination of the main reflector is significantly improved, without increasing spillover, by providing the subreflector with a peripheral area having a surface configuration and orientation for directing spillover from the central area of the subreflector onto the peripheral portion of the main reflector. This peripheral area of the subreflector preferably forms the surface of revolution of a conical section of the same kind as the central area of the subreflector but having a different focal length. Thus, in the illustrative embodiment of FIGS. 1–3 and 5 the hyperbolic subreflector 12 includes both a hyperbolic central area 12*a* and a hyperbolic peripheral area 12*b*. Both hyperboloids 12*a* and 12*b* have their virtual focal points $F_0$ at the phase center of the feed horn 11, but only the central hyperbolois 12*a* has its real focal point $F_1$ coincident with that of the paraboloid of the main reflector dish 10. The peripheral hyperboloid 12*b* has its real focal point $F_2$ spaced farther away from $F_0$ than $F_1$.

Figure 5:
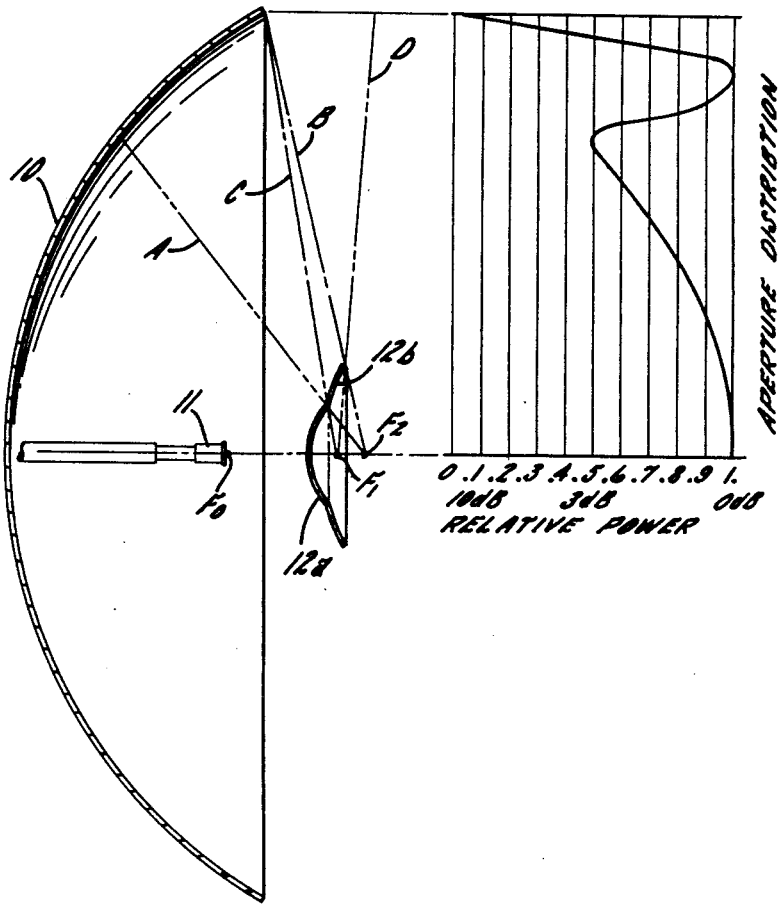
FIG. 5 is a schematic vertical section of an exemplary embodiment of the antenna of FIG. 1 and a power intensity profile therefor.

The effect of the dual-hyperbolic subreflector 12 is illustrated in FIG. 5, which shows a schematic cross section of the antenna and its power intensity profile. The dashed lines A and B indicate the area of the main reflector dish 10 that is double illuminated by both the central area 12*a* and the peripheral area 12*b* of the subreflector, and the resulting increase in the power intensity in this area of the main reflector dish 10 can be seen in the power intensity profile. More specifically, instead of tapering off smoothly by 10 dB at the edge of the dish 10, the power intensity profile tapers off by only about 3 dB at the inner edge of the area A–B, and then increases to the maximum intensity level of 1.0 again before it drops off to the 10 dB level at the edge of the dish. Thus, there is a considerable increase in the uniformity of illumination of the dish 10 without any increase in spillover.

Furthermore, the presence of the hyperbolic peripheral area 12*b* on the subreflector permits the central hyperbolic area 12*a* to be designed with less taper than required in a conventional Cassegrain antenna. Consequently, the uniformity of power intensity is also improved in the central area of the main reflector dish 10. In the particular embodiment illustrated in FIG. 5, the central hyperbolic area 12*a* of the subreflector is designed to have a taper of only 6 dB, i.e., if that hyperboloid alone were used to illuminate the main dish 10, the power intensity profile would taper off to only the 6 dB level, causing excessive spillover and reducing total antenna efficiency. Preferably, the inner hyperboloid is designed with a taper sufficiently high that the portion of the antenna system including only the central area 12*a* of the subreflector would produce a gain of less than about 40% by itself. With the secondary hyperbolic area 12*b* on the subreflector, however, the use of the lower-taper central hyperbolic area 12*a* increases the power intensity in the central area of the main dish 10 without increasing spillover. The outer hyperbolic area 12*b* intercepts energy down to the 14 dB level, for example, and reflects it onto the outer section A–B of the main dish, so that the overall effect is a significant increase in power intensity across substantially the entire face of the dish 10.

The importance of having the real focal points $F_1$ and $F_2$ of the two hyperboloids 12*a* and 12*b* spaced away from each other is illustrated by the dashed lines C and D in FIG. 5 These lines C and D show the area that would be illuminated by the outer hyperboloid 12*b* if the focal points $F_1$ and $F_2$ were coincident. It can be seen that the illumination would be substantially all spillover in that case. Of course, in addition to having its focal point $F_2$ located further away from $F_0$ than $F_1$, the outer hyperboloid 12*b* is preferably selected to meet the inner hyperboloid 12*a* so that the subreflector can be fabricated as a single piece.

The increase in power intensity effected by the dual-hyperboloid subreflector 12 is offset to some extent by a phase error introduced by the non-coincidence of the two focal points $F_1$ and $F_2$ of the two hyperboloids. (As is well known, the gain of a parabolic antenna is at a maximum when the aperture illumination is uniform with constant phase.) However, the increased illumination and reduced spillover effected by the outer hyperbolic area 12*b* are sufficiently great to produce a significant net increase in the total antenna efficiency. Indeed, total antenna efficiencies as high as 74% have been measured with antennas embodying this invention, which is a considerable increase over the typical 55% efficiency considered normal for Cassegrain antennas.

The antenna provided by this invention is intended primarily for use in terrestrial communication systems. A Cassegrain antenna with a different type of dual-surface subreflector has been proposed heretofore for use in a satellite-earth communications by P. D. Potter in his U.S. Pat. No. 3,209,361 and his article "Unique Feed System Improves Space Antennas" in *Electronics*, June 22, 1962, pp 36–40. The Potter antenna employs a peripheral flange designed to reflect microwaves from the warm ground into the feed horn so that these waves cancel similar ground waves reflected by the main central area of the subreflector. Conversely, in the transmitting mode, the subreflector flange in the Potter antenna reflects energy from the feed horn past the edge of the main reflector dish so as to cancel out energy that is reflected by the central area of the subreflector and bent around the edge of the main reflector dish. These results are, of course, opposed to those achieved by the peripheral portion of the subreflector of the present invention, which is designed to reflect energy onto, rather than past, the main reflector dish.

One of the advantages of the improved subreflector provided by this invention is that antennas already in service can be modified relatively easily in the field by retrofitting them with a feed system incorporating items 11, 12, and 13. Thus, the gain of existing antennas can be significantly increased by making a relatively simple and inexpensive field modification.

while the invention has been described thus far with specific reference to hyperbolic subreflectors, the invention is equally applicable to subreflectors of other geometric shapes. For example, other surfaces of revolution of conic sections that can be employed are ellipsoids (often referred to as "Gregorian") and paraboloids, provided the inner and outer conic sections always have different focal lengths, and the outer conic section is positioned to direct spillover from the inner section onto the outer peripheral area of the main reflector dish. Although the invention has been described with particular reference to the preferred embodiment in which the conic sections of the central and peripheral areas of the subreflector are of the same kind, the subreflector can be made with surfaces of revolution of conic sections of different kinds. For example, a central hyperboloid may be used with an outer paraboloid, or a central ellipsoid may be used with an outer paraboloid. Another alternative is to use a subreflector with a peripheral area forming a frustonoconical surface rather than a surface of revolution of a conic section.

The invention has also been described with specific reference to the use of surfaces of revolutions of only two different conic sections in a given subreflector, but it should be understood that the invention is applicable to any desired number of conic sections and/or frustoconical surfaces in a single subreflector. For example, the subreflector could have three different hyperboloids with three different focal points:

a center hyperboloid intercepting energy out to the 6 dB level, a middle hyperboloid intercepting energy out to the 9 dB level, and an outer hyperboloid intercepting energy out to the 15 dB level. The latter two hyperboloids would illuminate a sector narrower than the A–B region in FIG. 5 and therefore would have a smaller phase error.

As can be seen from the foregoing detailed description, this invention provides an improved Cassegrain antenna that provides increased total antenna efficiency and gain by achieving more uniform illumination of the main reflector dish without any increase in spillover. The antenna requires no modifications to the standard reflector dish, shroud or radome, so that existing prime focus feed antennas can be easily retrofitted in the field by making relatively inexpensive and simple field modifications of only the subreflector portions thereof.

I claim as my invention:

1. A Cassegrain antenna for use in terrestrial communication systems, said antenna comprising the combination of a parabolic main reflector, a primary feed horn, and a subreflector illuminated by the primary feed horn including a central area forming the surface of revolution of a hyperbolic conic section for providing tapered illumination of the main reflector in the transmitting mode, said central area providing an antenna gain of less than about 40% and at least one peripheral area of the same kind of conic section as said central area, said areas both having virtual focal points coincident with each other and with the phase center of the primary feed horn, and orientation for directing spillover from said central area onto the peripheral portion of the main reflector to improve the uniformity of illumination of the main reflector.

2. A Cassegrain antenna as set forth in claim 1 wherein said conic sections all have one focal point coincident with the phase center of the primary feed horn, and the other focal points are spaced apart on a line parallel to the direction of the main radiation beam of the parabolic main reflector.

3. A Cassegrain antenna as set forth in claim 1 wherein said central area of the subreflector provides an illumination taper of less than 10 dB.

4. A Cassegrain antenna as set forth in claim 1 wherein said peripheral area of the subreflector forms a surface of revolution of a conic section having a focal point located so that lines drawn through said focal point and the inner and outer extremities of said peripheral area intersect the main reflector.

5. A Cassegrain antenna as set forth in claim 1 wherein the periphery of the main reflector, the outer extremity of said peripheral area of the subreflector, and the focal point of said peripheral area of the subreflector all lie on a single straight line.

6. A Cassegrain antenna as set forth in claim 1 wherein the periphery of the main reflector, the outer extremity of said central area of the subreflector, and the focal point of said central area of the subreflector all lie on a single straight line.

* * * * *